US011217213B2

(12) United States Patent
Greene et al.

(10) Patent No.: US 11,217,213 B2
(45) Date of Patent: Jan. 4, 2022

(54) ACOUSTIC STRINGED INSTRUMENT BODY WITH PARTIAL TAPER SOUNDBOARD RECURVE

(71) Applicant: Dreadnought, Inc., Wilmington, DE (US)

(72) Inventors: Frederick E. Greene, Allentown, PA (US); Timothy A. Teel, Lehighton, PA (US)

(73) Assignee: DREADNOUGHT, INC, Wilmington, DE (US)

( * ) Notice: Subject to any disclaimer, the term of this patent is extended or adjusted under 35 U.S.C. 154(b) by 0 days.

(21) Appl. No.: 17/016,986

(22) Filed: Sep. 10, 2020

(65) Prior Publication Data

US 2021/0090529 A1 Mar. 25, 2021

Related U.S. Application Data

(60) Provisional application No. 62/904,196, filed on Sep. 23, 2019.

(51) Int. Cl.

| | |
|---|---|
| ***G10D 3/02*** | (2006.01) |
| ***G10D 1/08*** | (2006.01) |
| ***G10D 3/06*** | (2020.01) |

(52) U.S. Cl.

CPC ..... *G10D 3/02* (2013.01); *G10D 1/08* (2013.01); *G10D 3/06* (2013.01)

(58) Field of Classification Search

CPC ..... G10D 3/02; G10D 1/08; G10D 3/06

See application file for complete search history.

(56) References Cited

U.S. PATENT DOCUMENTS

| | | | | | |
|---|---|---|---|---|---|
| 1,361,182 | A * | 12/1920 | Reams, Jr. | G10D 1/06 | 84/291 |
| 2,070,391 | A * | 2/1937 | Bilhuber | G10C 3/06 | 84/192 |
| 3,443,466 | A | 5/1969 | Brakewell | | |
| 3,561,314 | A | 2/1971 | MacEachron | | |
| 3,656,395 | A * | 4/1972 | Kaman | G10D 3/02 | 84/267 |
| 5,320,018 | A | 6/1994 | Fandrich | | |
| 6,177,622 | B1 | 1/2001 | Green | | |
| 6,759,581 | B2 | 7/2004 | Taylor | | |
| 6,852,916 | B1 * | 2/2005 | Burguete | G10D 3/02 | 84/267 |
| 10,546,562 | B1 * | 1/2020 | Baldevarona | G10D 1/08 | |
| 10,777,172 | B1 * | 9/2020 | Katzenberger | G10D 3/02 | |
| 2020/0111457 | A1 * | 4/2020 | Klosowiak | B32B 3/266 | |

* cited by examiner

*Primary Examiner* — Jianchun Qin

(74) *Attorney, Agent, or Firm* — Stradley Ronon Stevens and Young, LLP

(57) ABSTRACT

A soundboard for a musical instrument having a body, a rear plate, and a lateral plate, with the soundboard, the rear plate, and the lateral plate defining a sound chamber for the musical instrument. The soundboard extends along a longitudinal axis and has a thickness. The soundboard also has a partial taper recurve asymmetrically disposed around the longitudinal axis. The recurve includes a first recurve section that forms a downward ramp which starts flush with the thickness of the soundboard, a second recurve section that defines the full depth of the partial taper recurve, and a third recurve section that forms an upward ramp which ends flush with the thickness of the soundboard. Also disclosed is a musical instrument comprising the soundboard. The musical instrument may be a guitar.

20 Claims, 6 Drawing Sheets

ACOUSTIC STRINGED INSTRUMENT BODY WITH PARTIAL TAPER SOUNDBOARD RECURVE

RELATED APPLICATION

This application claims the benefit of priority to U.S. Provisional Patent Application Ser. No. 62/904,196, filed on Sep. 23, 2019, the contents of which are incorporated in this application by reference.

TECHNICAL FIELD

The present invention relates generally to the soundboard of a stringed musical instrument such as a guitar and, more specifically, to a soundboard that includes a partial taper recurve that follows an asymmetrical path.

BACKGROUND OF THE DISCLOSURE

Music plays an important role in our daily lives and is woven into the fabric of society. Many people perform music as a pastime, a hobby, or an occupation. One of the main divisions of instruments, chordophone instruments are musical instruments that make sound by way of a vibrating string or strings stretched between two points. Chordophone instruments, and in particular stringed musical instruments, are very popular worldwide because they are versatile and suited to different genres of music. The most popular of the stringed musical instruments is probably the modern guitar, including both acoustic guitars which project sound acoustically and electric guitars which project sound through electrical amplification.

Conventional acoustic and electric guitars include a body and a neck that is attached to the body via a joint, with one or more elongate, flexible strings extending between the body and a distal end of the neck along a fretboard. (The terms "distal" or "distal end" are used to define the part or surface of an element which is positioned furthest from the user.) The body has a top surface called a soundboard, typically made from wood, that vibrates when the instrument is played. To provide an instrument with the most aesthetically pleasing tones, soundboards are usually tapered or feathered to thin the soundboard near its peripheral edge to allow more (freer) movement by the soundboard relative to the side wall of the instrument. Thus, the soundboard is tapered from its center to the periphery. The process of tapering a soundboard is difficult and time consuming, however, and frequently requires hours of hand sanding by a skilled craftsman (a luthier) to form a taper at the edges of the soundboard which is not visually apparent (i.e., the surface of the soundboard preferably has a flat appearance). Errors in the tapering process can result in uneven tapering or undesirably thin portions which can lead to cracking and breaking.

Therefore, one disadvantage associated with conventional soundboards is the difficult and time-consuming process of tapering a soundboard. Another disadvantage associated with conventional soundboards is the high cost of tapering a high-quality instrument soundboard. Yet another disadvantage associated with conventional soundboards involves the use of wood as a soundboard material. Wood soundboards tend to swell under humid conditions, causing changes in the visual appearance and tonal quality. In addition, cracking can occur in wood soundboards under dry conditions.

U.S. Pat. No. 6,759,581 issued to Taylor-Listug, Inc. and titled "Acoustic Stringed Instrument Body with Relief Cut" attempts to address the disadvantages highlighted above. As the title implies, provided is an acoustic stringed instrument body including a soundboard with a symmetrical relief cut around its periphery. The relief cut is located on the exterior or interior surface of the soundboard close to the perimeter of that surface. The relief cut may be in other locations, however, including closer to the sound hole. The relief cut ostensibly forms a more flexible coupling between the soundboard and the sidewall of the instrument, which is represented to improve the tone of the instrument by allowing the soundboard to vibrate more freely. The relief cut in the soundboard is also represented to permit stretching and contraction of the wooden soundboard due to changes in atmospheric conditions.

According to the patent disclosure, the time-consuming process of tapering the soundboard surface is replaced with the localized relief cut. Referring to FIG. 1 of the patent, a dotted line 45 which follows the contour of the soundboard 30 is present inside of the perimeter of the soundboard 30. This dotted line 45 represents the general location of relief cuts 100, 110, 120, 130, 140, and 150, which are located on the soundboard 30. The cross-sectional area of the relief cut 100 may be varied along the soundboard 30, and the relief cut 100 may also have differing shapes and dimensions. The soundboard with relief cut disclosed by the '581 patent requires, however, that the soundboard return to its full thickness at the gluing surfaces of the soundboard and sides.

In view of the disadvantages outlined above, there exists a need for an acoustic musical instrument soundboard that does not require its own taper to achieve good tonal quality. There also exists a need for a wooden acoustic musical instrument soundboard that is robustly designed to be resistant to changes in atmospheric conditions such as humidity and temperature levels. Another need exists for a soundboard that, especially when combined with other components of a musical instrument, achieves tonal optimization.

BRIEF SUMMARY OF THE DISCLOSURE

To meet these and other needs and to overcome the disadvantages of existing designs, a soundboard that includes a partial taper recurve is provided. An object of the present disclosure is to achieve greater flexibility in strategic areas of the soundboard. A related object is to produce a desired tonal effect for a musical instrument having a soundboard. Another related object is to allow for tonal optimization based on the body shape of the musical instrument having the soundboard. Yet another object is to target specific regions of the soundboard to maximize the desired tonal effect. It is still another object of the present disclosure to allow for the selection of the width and position of the relieved areas on a soundboard.

To achieve these and other objects, and in view of its purposes, the present disclosure provides a soundboard for a musical instrument having a body, a rear plate, and a lateral plate, with the soundboard, the rear plate, and the lateral plate defining a sound chamber for the musical instrument. The soundboard extends along a longitudinal axis and has a thickness. The soundboard also has a partial taper recurve asymmetrically disposed around the longitudinal axis. The recurve includes a first recurve section that forms a downward ramp which starts flush with the thickness of the soundboard, a second recurve section that defines the full depth of the partial taper recurve, and a third recurve section that forms an upward ramp which ends flush with the thickness of the soundboard. Also disclosed is a musical instrument comprising the soundboard. The musical instrument may be a guitar.

It is to be understood that both the foregoing general description and the following detailed description are exemplary, but are not restrictive, of the invention.

BRIEF DESCRIPTION OF THE DRAWING

The disclosure is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE TECHNOLOGY

The stringed musical instruments in accordance with the present invention may include guitars, such as acoustic guitars, solid body electric guitars, and acoustic electric guitars, but may also include other stringed musical instruments such as, for example, banjos, mandolins, violins, lutes, and/or other similar instruments. Although the principles of the present disclosure are described in connection with guitars, it should be understood that the principles disclosed are also applicable to other stringed musical instruments which have an instrument body and an elongated neck along which the strings are stretched.

Figure 1:
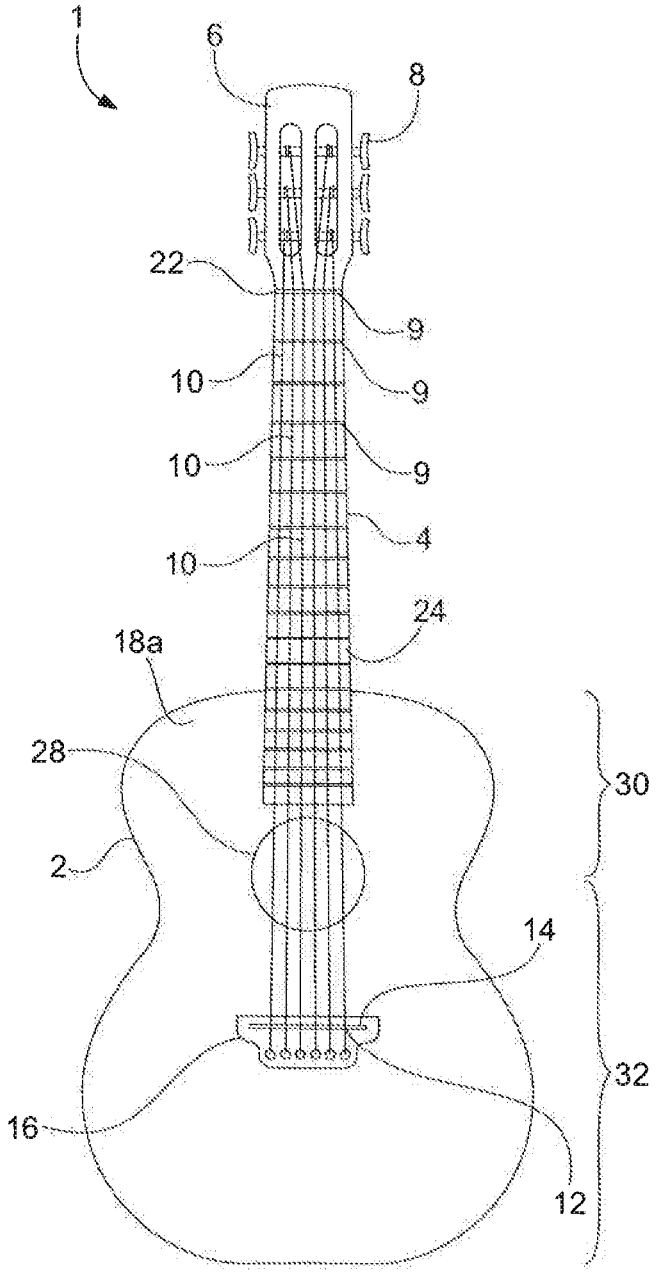
FIG. 1 is a diagrammatic perspective view of a conventional guitar.
Figure 2:
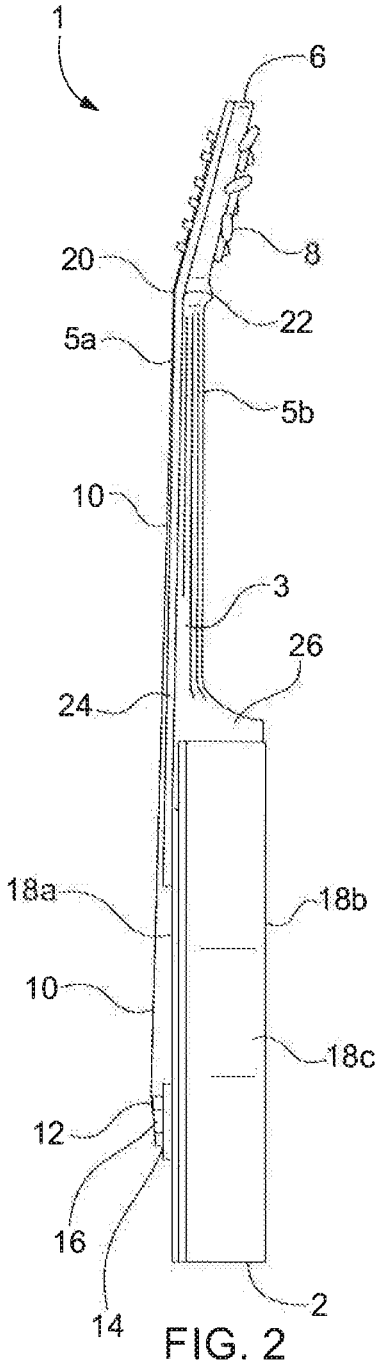
FIG. 2 is a diagrammatic side view of the guitar illustrated in FIG. 1.

Refer now to the drawing, in which like reference numbers designate like elements throughout the various figures that comprise the drawing. Turning first to FIGS. 1 and 2, a brief description concerning the various components of the stringed instrument, according to both the prior art and the present invention, will now be briefly discussed. As shown in these figures, the guitar 1 has a guitar body 2 connected to a neck 4 in a conventional manner. The body 2 is comprised of a front plate 18*a* having a circular sound hole 28, a rear plate 18*b* facing the front plate 18*a*, and a lateral plate 18*c* combined with edges of the front plate 18*a* and the rear plate 18*b* in a way to be spaced apart from each other. Sound resonance is generated in the internal space formed by the front plate 18*a*, the rear plate 18*b*, and the lateral plate 18*c*. Further, formed in one side of the body 2 is an aperture into which the neck 4 is inserted.

The neck 4 takes the form of a beam 3 having a considerable thickness with a top surface 5*a* and a bottom surface 5*b*. The neck 4 typically comprises a wood or some other similar or conventional material, which is suitable to withstand continual string pull without warping or twisting. The neck 4 has an integral headstock 6 which holds a number of separate tuning pegs 8 (typically six or possibly twelve tuning pegs) which each, in turn, respectively retain a free end of a desired string 10 in a conventional manner. The strings 10 are strung at substantial tension (e.g., about 30 pounds of tension per string) and extend from a first fixed point or axis 12, formed by a saddle 14 supported by a bridge 16 which is permanently affixed to the front plate 18*a* of the guitar body 2, to a second fixed axis 20, formed by a nut 22 which is permanently affixed to the top surface 5*a* of the neck 4, located adjacent the headstock 6. Further, installed inside the beam 3 of the neck 4 is an adjustment rod (not shown) for preventing the neck 4 from bending or being distorted by the tension force of the guitar strings 10.

A fingerboard (also known as a fretboard 24 on fretted instruments) is an important component of most stringed instruments. The fretboard 24 is a thin, long strip of hard material, usually a re-enforced polymer or wood such as rosewood or ebony, that mates with and is formed on the top surface 5*a* of the neck 4 so as to be located between and space a remainder of the neck 4 from the strings 10. The material from which the fretboard 24 is manufactured should be strong, durable, and stable enough to support and retain the metal frets 9, which are installed on top of the fretboard 24 at regular intervals, and withstand playing wear through years of use. The strings 10 run over the fretboard 24 between the nut 22 and the bridge 16. For conventional guitars, a heel 26 is formed integrally with a remainder of the neck 4 and extends from the bottom surface 5*b* of the neck 4. By "integral" is meant a single piece or a single unitary part that is complete by itself without additional pieces, i.e., the part is of one monolithic piece formed as a unit with another part.

As shown in FIG. 1, the upper bout 30 is the part of the guitar body 2 that is nearest the neck 4; the upper bout 30 extends approximately from the top of the body 2 to the middle of the sound hole 28. The lower bout 32 is the largest part of the guitar body 2 that is nearest to the string termination at the bridge 16; the lower bout 32 extends approximately from the middle of the sound hole 28 to the bottom of the body 2.

Figure 3:
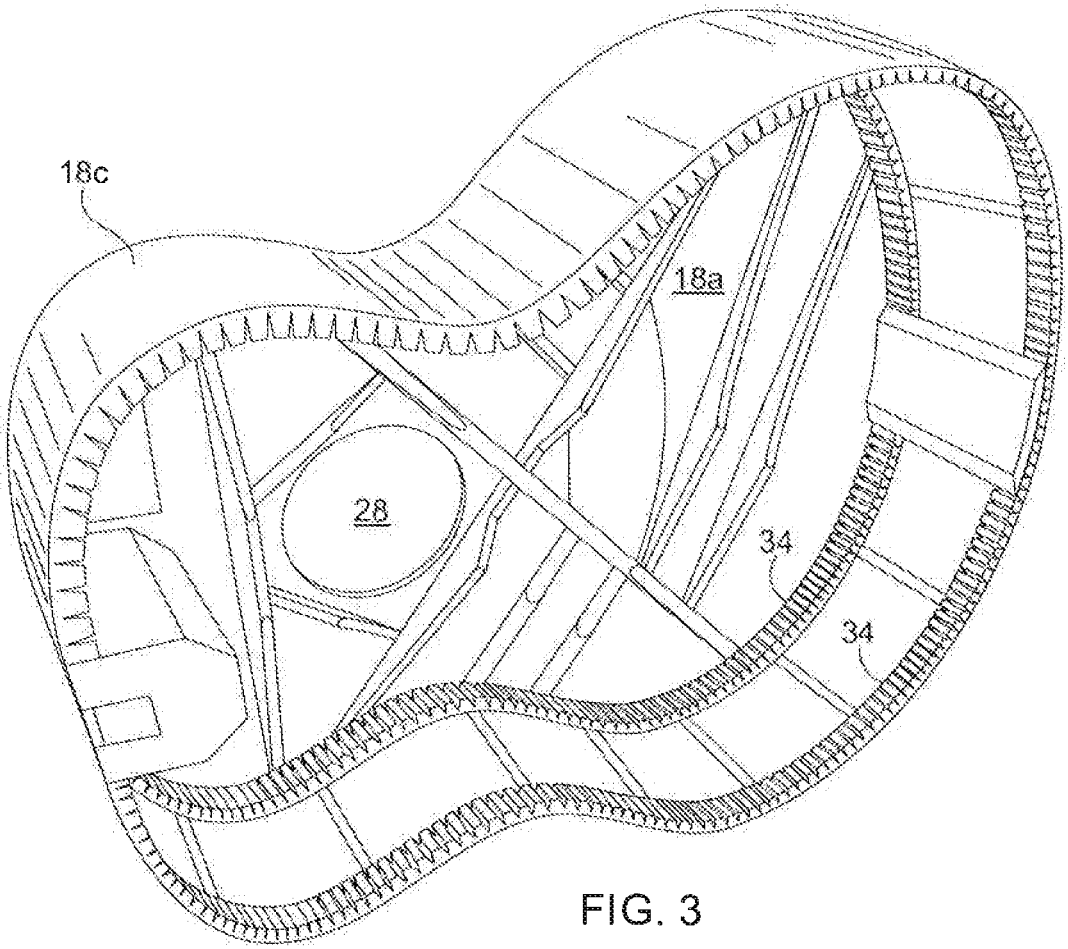
FIG. 3 is a perspective view of a guitar highlighting the kerfed lining.

As shown in FIG. 3, the guitar 1 can include a kerfed lining 34 at the junction between the front plate 18*a* and the lateral plate 18*c* and at the junction between the rear plate 18*b* (not shown in FIG. 3) and the lateral plate 18*c*. The process of "kerfing" the guitar 1 forms a surface for gluing and reinforcing the front plate 18*a*, the rear plate 18*b*, and the lateral plate 18*c* of the guitar 1. Each lining 34 is kerfed (slotted) to allow easy bending to fit the curved components of the guitar 1.

When using the guitar 1, the musician moves his or her fingers up and down the neck 4, pressing the strings 10 so as to shorten them and create various pitches as the strings 10 are strummed, plucked, or otherwise excited. Typically, the frets 9 on the fretboard 24 extend across the width of the neck 4 so as to provide a place to anchor the ends of the shortened strings 10 at definite or desired locations.

Normally, the strings 10 are tuned to pitch at the top of the neck 4 or headstock 6 where the tuning pegs 8 increase or decrease the tension on each string 10. The user then renders the desired notes by strumming the strings 10 near the middle of the guitar body 2 while pressing the strings 10 which extend over the neck 4 onto the fretboard 24 attached to the top surface 5*a* of the neck 4. The tone of the note produced depends on the tension of the string 10 and the distance between the fret 9 at which the string 10 is depressed onto the neck 4 and the lower anchor point. The smaller the distance between the depressed string 10 and the bridge 16, the higher pitch the resulting tone will be. Increasing the tension of the strings 10 will also produce a note with a higher pitch.

In the case of an acoustic instrument, such as an acoustic guitar 1, the body 2 encloses a resonant sound chamber. Strumming, plucking, or otherwise exciting the strings 10 causes the strings 10 to vibrate. This vibration in turn causes the bridge 16 over which the strings 10 extend to vibrate. In fact, the bridge 16 forms the vibrating end point of the strings 10 for every note that is played. Vibration of the bridge 16 in turn causes the front plate 18*a* of the acoustic instrument, known as the soundboard, to vibrate as well, which in turn causes air entrapped in the sound chamber to move to generate the sound heard through the sound hole 28 upon play of the instrument. The vibration of the soundboard 18*a* greatly influences the tone of the guitar 1. As a general rule, the more freely the soundboard 18*a* can vibrate, the louder and better the tone of the guitar 1.

Figure 4:
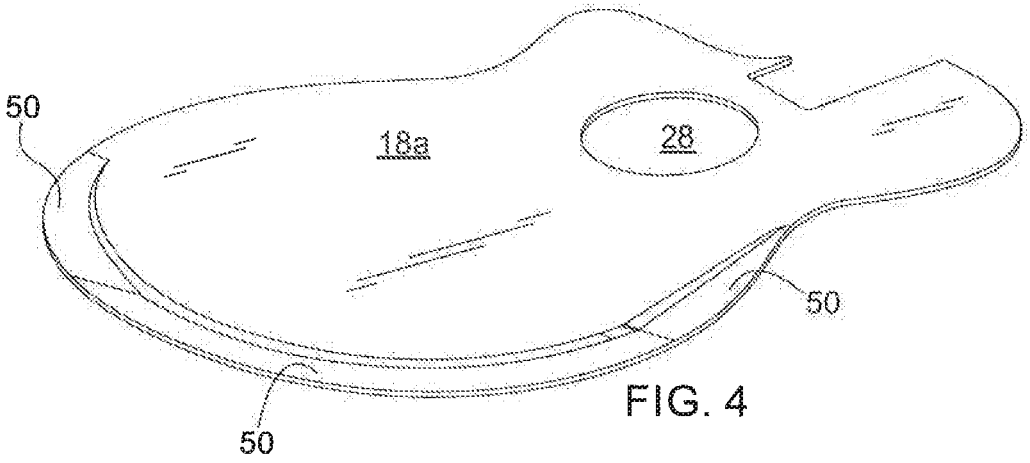
FIG. 4 is a perspective view of the bottom or inside surface of the soundboard highlighting the partial taper soundboard recurve.
Figure 5:
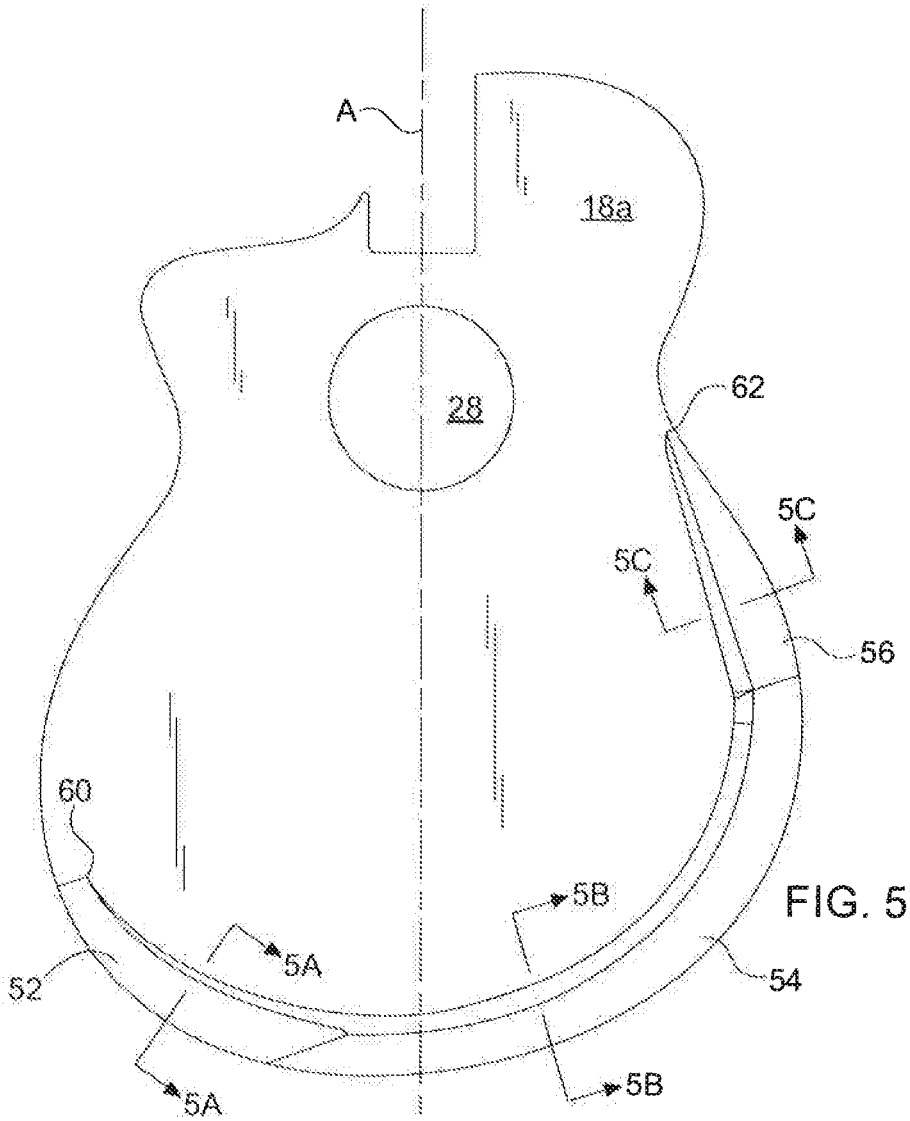
FIG. 5 is a bottom view of the soundboard shown in FIG. 4.

Returning to the structure of the guitar 1, highlighted in FIGS. 4 and 5 is the soundboard 18*a*. FIG. 4 is a perspective view of the bottom or inside surface of the soundboard 18*a*, which is the surface of the soundboard 18*a* that helps to define the sound chamber. The soundboard 18*a* has a partial taper soundboard recurve 50 located on that inside surface. FIG. 5 is a bottom view of the soundboard 18*a*. The recurve 50 can be manufactured in a number of different ways. Mechanical cutting and abrasive removal using an abrasive wheel are two example manufacturing processes, as would be known to an artisan.

In one example embodiment, the recurve 50 of the soundboard 18*a* starts at or near (i.e., proximate) the terminus of the treble side X-brace at a point 60 and extends to or near (i.e., proximate) a point 62 just below the bass side waist. The recurve 50 is asymmetrical about a longitudinal axis A of the body 2 and, because it forms part of the body 2, of the soundboard 18*a*. The recurve 50 includes three, main components: a first recurve section 52, an intermediate or second recurve section 54, and a third recurve section 56.

Figure 5A:
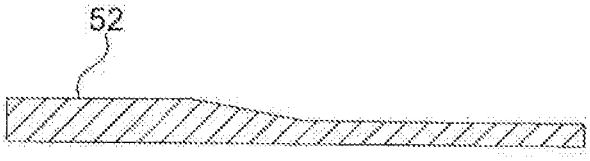
FIG. 5A is a cross-sectional view, along the line 5A-5A of FIG. 5, illustrating the edge of the first recurve section of the recurve.
Figure 6:
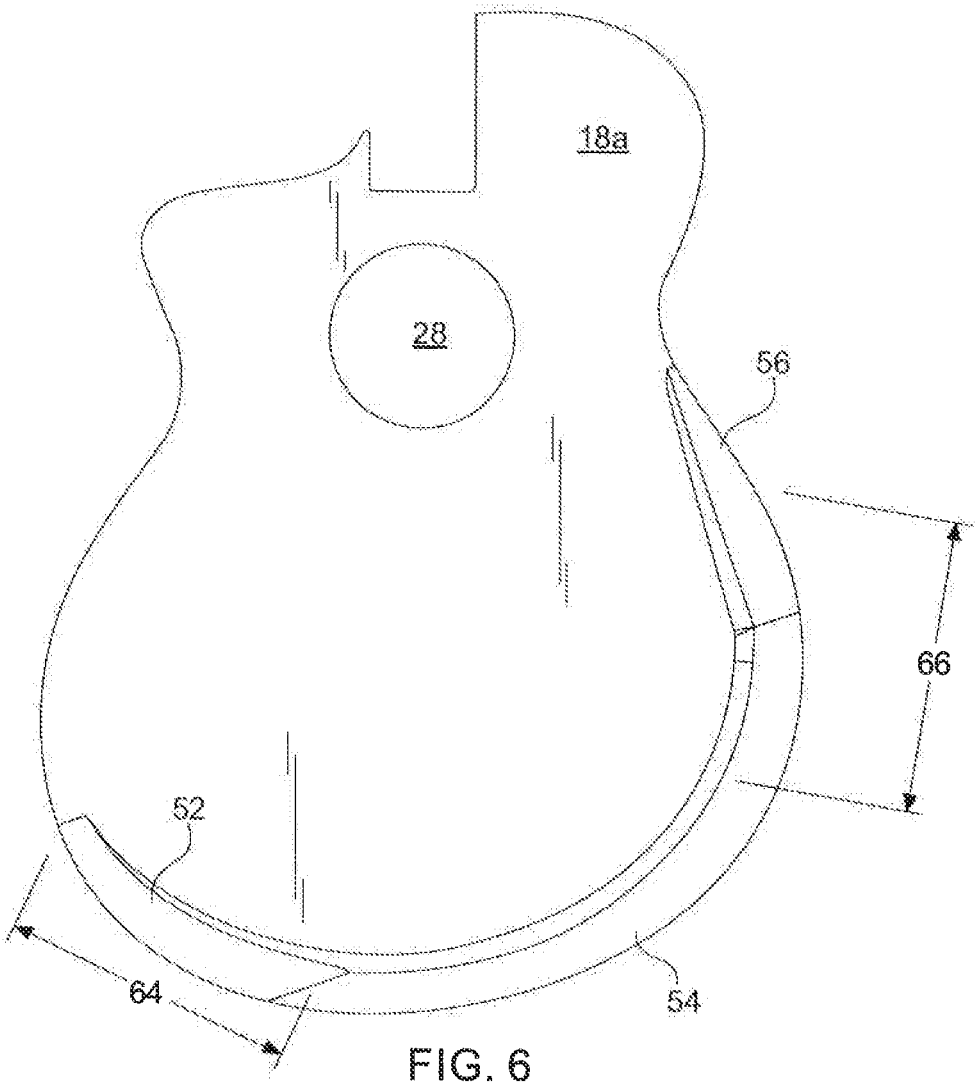
FIG. 6 is a bottom view of the soundboard shown in FIGS. 4 and 5, highlighting certain dimensions of the recurve.

The first recurve section 52, which defines the start of the recurve 50, forms a downward ramp which starts flush with the original thickness of the soundboard 18*a*. In one example embodiment, shown in FIG. 6, the first recurve section 52 forms a first dimension 64 that defines a six-inch (15.25 cm) ramp cut out of the lower bout perimeter of the back side to the level of the soundboard 18*a*. FIG. 5A is a cross-sectional view, along the line 5A-5A of FIG. 5, illustrating the edge of the first recurve section 52.

Figure 5B:
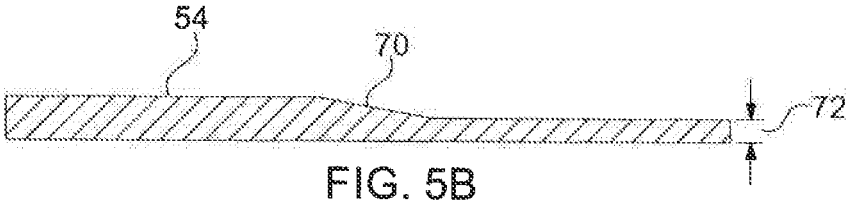
FIG. 5B is a cross-sectional view, along the line 5B-5B of FIG. 5, illustrating the edge of the second recurve section of the recurve.

In the second recurve section 54, the recurve 50 has reached its full depth. The transition between the first recurve section 52 and the second recurve section 54 is formed, in the illustrated example, by a first 1.5-inch (3.8 cm) radius corner blend 70 cut along the undercut. FIG. 5B is a cross-sectional view, along the line 5B-5B of FIG. 5, illustrating the edge of the second recurve section 54. FIG. 5B also illustrates an example edge thickness 72, which may be about 0.070 inches (0.18 cm). The transition between the second recurve section 54 and the third recurve section 56 is formed, in the illustrated example, by a second 1.5-inch (3.8 cm) radius corner blend 74 cut along the undercut.

Figure 5C:
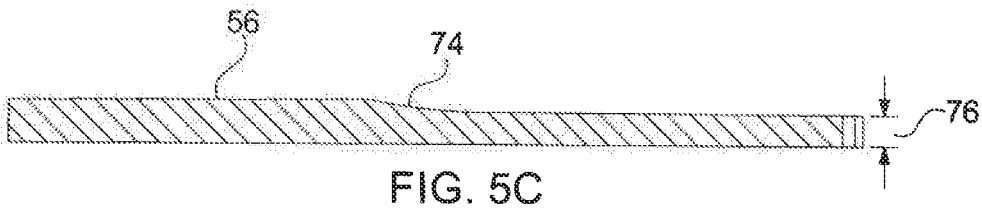
FIG. 5C is a cross-sectional view, along the line 5C-5C of FIG. 5, illustrating the edge of the third recurve section of the recurve.

The third recurve section 56, which defines the end of the recurve 50, forms an upward ramp which ends flush with the original thickness of the soundboard 18*a*. In one example embodiment, shown in FIG. 6, the third recurve section 56 forms a second dimension 66 that defines a six-inch (15.25 cm) ramp cut into the lower bout back side of the soundboard 18*a* to a depth of about 0.050 inches (0.125 cm). FIG. 5C is a cross-sectional view, along the line 5C-5C of FIG. 5, illustrating the edge of the third recurve section 56. FIG. 5B illustrates the second radius corner blend 74 and an example edge thickness 76 (which approximates the full thickness of the soundboard 18*a*) for the third recurve section 56.

The precise geometry of the recurve 50 can be adjusted, in combination with (among other structural characteristics of the guitar 1) the bracing that is also located on the bottom of the soundboard 18*a*, to achieve desired tonal qualities. Guitar bracing refers to the system of struts (typically wooden) that internally support and reinforce the soundboard 18*a* and back or rear plate 18*b* of acoustic guitars. Bracing of the soundboard 18*a* (or top bracing) transmits the forces exerted by the strings 10 from the bridge 16 to the rim or lateral plate 18*c*. The luthier faces the challenge of bracing the guitar 1 to withstand the stress applied by the strings 10 with minimal distortion, while permitting the soundboard 18*a* to respond as fully as possible to the tones generated by the strings 10. Brace design contributes significantly to the type of sound the guitar 1 will produce. The rear plate 18*b* of the guitar 1 is braced to help distribute the force exerted by the neck 4 on the body 2, and to maintain the tonal responsiveness and structural integrity of the sound box. Braces may be made from top woods (spruce or cedar), balsa wood or, in certain instruments, carbon fiber composites.

Figure 7:
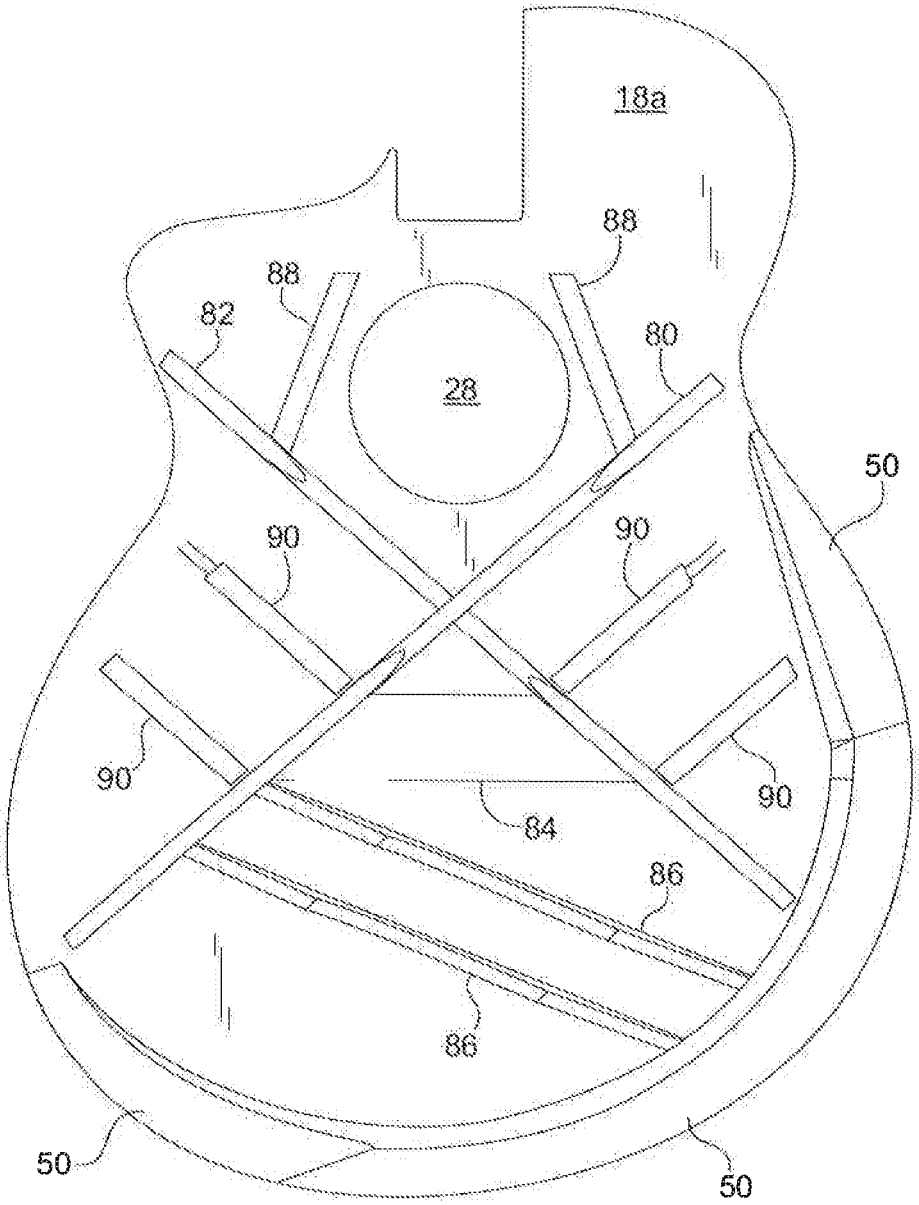
FIG. 7 illustrates just one example of bracing suitable for the soundboard of the guitar.

FIG. 7 illustrates just one example of bracing suitable for the soundboard 18*a* of the guitar 1. In the example shown, the soundboard 18*a* is braced using the X-brace system, or a variation of the X-brace system, generally attributed to Christian Frederick Martin between 1840 and 1845 for use in gut string guitars. The system consists of two braces 80, 82 forming an "X" shape across the soundboard 18*a* below the top of the sound hole 28. The lower arms of the "X" straddle and support the ends of the bridge 16. Under the bridge 16 is a bridge patch 84 (typically hardwood) which prevents the ball end of the strings 10 from damaging the underside of the soundboard 18*a*. Below the bridge patch 84 are one or more tone bars 86 which support the bottom of the soundboard 18*a*. The tone bars 86 abut one of the X braces, for example the X-brace 80, and usually slant down towards the bottom edge of the soundboard 18*a*. The top tone bar 86 butts against a portion of the bridge patch 84 in most instruments. On either side of the sound hole 28 are angled braces 88 that vertically span the horizontal transition between the upper bout 30 and the lower bout 32 of the soundboard 18*a*. Around the lower bout 32, small finger braces 90 support the area between the X-braces 80, 82 and the edge of the soundboard 18*a*.

In summary, the acoustic stringed instrument body 2 having the soundboard 18*a* with the partial taper soundboard recurve 50 features an asymmetrical recurve 50 that starts and ends flush with the original thickness of the soundboard 18*a*. In addition, the partial soundboard taper recurve 50 extends from inside the body perimeter past the kerfed lining 34 to the edge of the stringed instrument side. (In alternative embodiments, however, the recurve 50 might be applied to areas of the interior or bottom of the soundboard 18*a* that would not extend to the edge of the soundboard 18*a*.) The recurve 50 extends to the very edge of the body 2 and attaches to the rim defined by the lateral plate 18*c* of the guitar 1. The variable width of the partial taper soundboard recurve 50 allows for tonal optimization based on body style. The partial taper soundboard recurve 50 ramps to its full depth over a variable distance and ramps back up over a variable distance, the lengths of which may be optimized for specific stringed musical instruments.

The guitar body 2 is typically made of wood. According to other embodiments, however, the guitar body 2 may be made of plastic, graphite, or other appropriate materials. The partial taper soundboard recurve 50 is applicable to wood materials as well as alternative materials including, but not limited to composite, carbon fiber, and laminate, and could be formed directly into such materials without necessitating any type of cut.

The soundboard 18*a* with the partial taper soundboard recurve 50 when glued to a normally sanded stringed instrument rim will display a slight downward slanting arch (relative to the torsion of the stringed instrument bridge 16) which is strong and stable. The partial taper recurve 50 follows an asymmetrical path, resulting in a thinned tapered edge toward the gluing surfaces which coves back to full depth toward the middle of the soundboard 18*a*. The partial taper recurve 50 results in greater flexibility in strategic areas of the soundboard 18*a* to produce a desired tonal effect.

The recurve 50 achieves an improvement in tonal response in comparison to conventionally built acoustic stringed instruments. The recurve 50 can be discretely applied to different acoustic stringed instrument body shapes and bracing styles. Unlike the soundboard with a relief cut known in the art, which requires that the soundboard of the instrument return to its full thickness at the gluing surfaces of the soundboard and sides, the recurve 50 allows the soundboard 18*a* to retain its altered depth to the complete edge in the areas needed for the optimal tonal response. In addition, the known soundboard with a relief cut affects changes only in the internal geometry of the acoustic stringed instrument; the partial taper soundboard recurve 50 changes the overall external dimensions of the acoustic stringed instrument in such a way that slight arching is induced in key areas to mitigate soundboard deformation when string tension is applied. Therefore, the acoustic stringed instrument body 2 having the soundboard 18*a* with the partial taper soundboard recurve 50 affects both the interior and exterior of an acoustic stringed instrument soundboard top and/or back. A visual advantage is that the soundboard 18*a* still looks like a traditional flattop guitar because the asymmetrical recurve 50 is on the bottom or inside surface of the soundboard 18*a*.

Another advantage relative to the known art is that the partial taper soundboard recurve 50 allows for the selection of the width and position of the relieved areas. Still another advantage is that the recurve 50 targets specific regions of the soundboard 18*a* to maximize the desired tonal effect. The variable width of the partial taper soundboard recurve 50 allows for tonal optimization based on body shape.

Although illustrated and described above with reference to certain specific embodiments and examples, the present invention is nevertheless not intended to be limited to the details shown. Rather, various modifications may be made in the details within the scope and range of equivalents of the claims and without departing from the spirit of the invention. It is expressly intended, for example, that all ranges broadly recited in this document include within their scope all narrower ranges which fall within the broader ranges.

What is claimed:

1. A soundboard for a musical instrument having a body, a rear plate, and a lateral plate, with the soundboard, the rear plate, and the lateral plate defining a sound chamber for the musical instrument, the soundboard extending along a longitudinal axis and comprising:

a thickness; and a partial taper recurve asymmetrically disposed around the longitudinal axis and including a first recurve section that forms a downward ramp which starts flush with the thickness of the soundboard, a second recurve section that defines the full depth of the partial taper recurve, and a third recurve section that forms an upward ramp which ends flush with the thickness of the soundboard, wherein the first recurve section ramps from the thickness of the soundboard to its full depth over a first distance, the third recurve section ramps from its full depth to the thickness of the soundboard over a second distance, and the first and second distances are varied to optimized the tonal performance of the musical instrument.

2. The soundboard according to claim 1, wherein the partial taper recurve has a variable width.

3. The soundboard according to claim 1, wherein a transition between the first recurve section and the second recurve section is formed by a first radius corner blend.

4. The soundboard according to claim 3, wherein the first radius corner blend is about 3.8 cm.

5. The soundboard according to claim 1, wherein a transition between the second recurve section and the third recurve section is formed by a second radius corner blend.

6. The soundboard according to claim 5, wherein the second radius corner blend is about 3.8 cm.

7. The soundboard according to claim 1 further comprising an X-brace system configured to brace the soundboard.

8. The soundboard according to claim 1 wherein at least one of the downward ramp formed by the first recurve section and the upward ramp formed by the third recurve section extends about 15.25 cm.

9. The musical instrument comprising the soundboard according to claim 1.

10. The musical instrument according to claim 9, wherein the musical instrument is a guitar.

11. The musical instrument according to claim 10, wherein the guitar has a bass side waist and a treble side X-brace with a terminus and the partial taper recurve starts at or near the terminus of the treble side X-brace and extends to or near a point just below the bass side waist.

12. The musical instrument according to claim 10, wherein a transition between the first recurve section and the second recurve section is formed by a first radius corner blend.

13. The musical instrument according to claim 10, wherein a transition between the second recurve section and the third recurve section is formed by a second radius corner blend.

14. The musical instrument according to claim 10 further comprising an X-brace system configured to brace the soundboard.

15. The musical instrument according to claim 10, wherein the body of the guitar has an edge and the lateral plate of the guitar defines a rim and the partial taper recurve extends to the edge of the body and attaches to the rim defined by the lateral plate.

16. The musical instrument according to claim 10 further comprising a junction between the soundboard and the lateral plate, a junction between the rear plate and the lateral plate, and a kerfed lining at one or both of the junctions.

17. A musical instrument comprising:

a body;

a rear plate;

a lateral plate; and a soundboard extending along a longitudinal axis and having a thickness and a partial taper recurve asymmetrically disposed around the longitudinal axis and including a first recurve section that forms a downward ramp which starts flush with the thickness of the soundboard, a second recurve section that defines the full depth of the partial taper recurve, and a third recurve section that forms an upward ramp which ends flush with the thickness of the soundboard, wherein the partial taper recurve has a variable width, the first recurve section ramps from the thickness of the soundboard to its full depth over a first distance, the third recurve section ramps from its full depth to the thickness of the soundboard over a second distance, the first and second distances are varied to optimize the tonal performance of the musical instrument, a transition between the first recurve section and the second recurve section is formed by a first radius corner blend, and a transition between the second recurve section and the third recurve section is formed by a second radius corner blend, wherein the soundboard, the rear plate, and the lateral plate define a sound chamber for the musical instrument.

18. The musical instrument according to claim 17 further comprising an X-brace system configured to brace the soundboard.

19. The musical instrument according to claim 17, wherein the musical instrument is a guitar.

20. A musical instrument comprising:

a body;

a rear plate;

a lateral plate; and a soundboard extending along a longitudinal axis and having a thickness and a partial taper recurve asymmetrically disposed around the longitudinal axis and including a first recurve section that forms a downward ramp which starts flush with the thickness of the soundboard, a second recurve section that defines the full depth of the partial taper recurve, and a third recurve section that forms an upward ramp which ends flush with the thickness of the soundboard, wherein the first recurve section ramps from the thickness of the soundboard to its full depth over a first distance, the third recurve section ramps from its full depth to the thickness of the soundboard over a second distance, the first and second distances are varied to optimize the tonal performance of the musical instrument, and wherein the soundboard, the rear plate, and the lateral plate define a sound chamber for the musical instrument.

* * * * *